United States Patent [19]

Brown

[11] Patent Number: 4,530,691

[45] Date of Patent: Jul. 23, 1985

[54] CENTRIFUGE WITH MOVABLE MANDREL

[75] Inventor: Richard I. Brown, Northbrook, Ill.

[73] Assignee: Baxter Travenol Laboratories, Inc., Deerfield, Ill.

[21] Appl. No.: 560,880

[22] Filed: Dec. 13, 1983

[51] Int. Cl.[3] ..... B04B 1/06

[52] U.S. Cl. ..... 494/45; 210/927; 494/65

[58] Field of Search ..... 494/20, 21, 18, 84, 494/45, 65; 604/4-6, 408; 210/787, 927, 512.1

[56] References Cited

U.S. PATENT DOCUMENTS

| | | | |
|---|---|---|---|
| 3,145,713 | 8/1964 | Latham | 494/45 |
| 3,244,363 | 4/1966 | Hein | 494/45 |
| 3,858,796 | 1/1975 | Unger et al. | 210/927 |
| 3,987,961 | 10/1976 | Sinn et al. | 210/927 |
| 4,109,855 | 8/1978 | Brown et al. | 494/18 |
| 4,142,670 | 3/1979 | Ishimara et al. | 494/45 |
| 4,151,844 | 5/1979 | Cullis et al. | 210/927 |
| 4,413,771 | 11/1983 | Rohde et al. | 494/17 |
| 4,413,772 | 11/1983 | Rohde et al. | 494/17 |
| 4,413,773 | 11/1983 | Rohde et al. | 494/37 |

*Primary Examiner*—Barry S. Richman
*Assistant Examiner*—John Donofrio
*Attorney, Agent, or Firm*—Paul C. Flattery; Daniel D. Ryan; Bradford R. L. Price

[57] ABSTRACT

There is disclosed herein a liquid processing apparatus for use in centrifugal apheresis in which whole blood is received from a donor, separated into therapeutic components and selectively collected. The apparatus includes a processing chamber support system for cooperating in controlling the volume of a variable-volume blood processing chamber during apheresis. The support system is constructed to spin about a spin axis and is substantially symmetric about said axis.

The elements of the support system include a chamber cover for receiving a variable-volume chamber. A mandrel is provided for engaging the variable-volume chamber and applying a conforming force to the chamber by urging the chamber toward the cover and thereby causing the chamber to conform to the shape of the cover. Thus the chamber is positioned between the cover and mandrel during apheresis, and the cover and mandrel cooperate in controlling the volume and shape of the chamber.

The apparatus and chamber define an annular blood volume having a blood sedimentation surface and a cylindrical plasma volume having a cylindrical blood/-plasma interface. The area of the blood sedimentation surface is greater than the interface area so as to maximize blood cell separation while minimizing platelet separation during the red blood cell separation and collection.

16 Claims, 4 Drawing Figures

36

A
M
34
23
24
10
16
28
12
38
20
32
30
30f
14
18
26
22
CONTROL
M
A

CENTRIFUGE WITH MOVABLE MANDREL

BACKGROUND OF THE INVENTION

This invention relates to a centrifugal liquid processing apparatus, and more particularly, to an improved apparatus for centrifugal apheresis, such as plasmapheresis or plateletapheresis.

In recent years the separation of whole blood into therapeutic components, such as red blood cells, platelets and plasma, and collection of those components has increased significantly. The separation is generally achieved in a centrifuge and is referred to as centrifugal apheresis.

In centrifugal processing, whole blood is delivered to a processing chamber where the blood is centrifugally separated into therapeutic components. The processing chamber is commonly bowl-shaped, rigid and disposable.

Presently whole blood is taken from a donor at a donation site and is then transported in a sterile container to a central processing laboratory where it is processed for separation and collection of the therapeutic components.

The apparatus used at the processing laboratory for centrifugal apheresis is bulky, expensive and usually not conducive for use at the donation site. However, on-site processing is becoming more popular since the time, handling and storage between donation and processing can be minimized. Furthermore, therapeutic component yield can be increased if processing for separation and collection is performed during donation. For example, in on-site processing greater quantities of platelets can be collected because greater quantities of whole blood can be processed for platelets and returned to the donor. Since the volume of blood being processed may vary and the chamber volume may vary during component separation and processing, the processing bowls and the apparatus which cooperates with the bowls must be capable of handling the varying volumes.

In U.S. patent application, Ser. No. 560,946 filed on even date herewith and entitled "Flexible Disposable Centrifuge Chamber", there is disclosed a flexible, variable-volume, bowl-shaped chamber which can be used in on-site processing apparatus.

It is the object of this invention to provide an apparatus for on-site centrifugal apheresis which is constructed for use in systems where the volume of biological fluids processed is variable.

It is another object of this invention to provide an apparatus for on-site apheresis which is convenient to use and of a lower cost to manufacture.

These and other objects of this invention will become apparent from the following description and appended claims.

SUMMARY OF THE INVENTION

There is provided by this invention a centrifugal liquid processing apparatus for use in the onsite processing of whole blood into therapeutic constituents by centrifugal apheresis (e.g., plasmapheresis or plateletpheresis). The apparatus is particularly useful with a flexible, variable-volume, processing chamber and includes a chamber bowl or cover for receiving the processing chamber. A chamber-engaging mandrel is provided for engaging said chamber and causing the chamber to conform to the cover and for cooperation in controlling the volume of said chamber. The cover and mandrel are spun about a spin axis and the processing chamber spins therewith for separating the components. Fluid conduits are provided for connecting the chamber to the donor and to external sites for the collection of the therapeutic components.

The mandrel, cover and chamber cooperate to define a blood-collecting volume generally along the side walls of the chamber and a central plasma collecting volume at the base of the chamber. These volumes are substantially equal and remain equal as the total chamber volume changes.

Furthermore, the chamber is configured so that the surface area at which red blood cells will separate is greater than the surface area of the red blood cell/-plasma interface. The result of the volume and surface area relationships is to maximize red blood cell (RBC) separation while minimizing platelet sedimentation back into the red blood cell bed or packed cell bed during RBC separation and collection.

DESCRIPTION OF THE PREFERRED EMBODIMENT

The System in General

Figure 1:
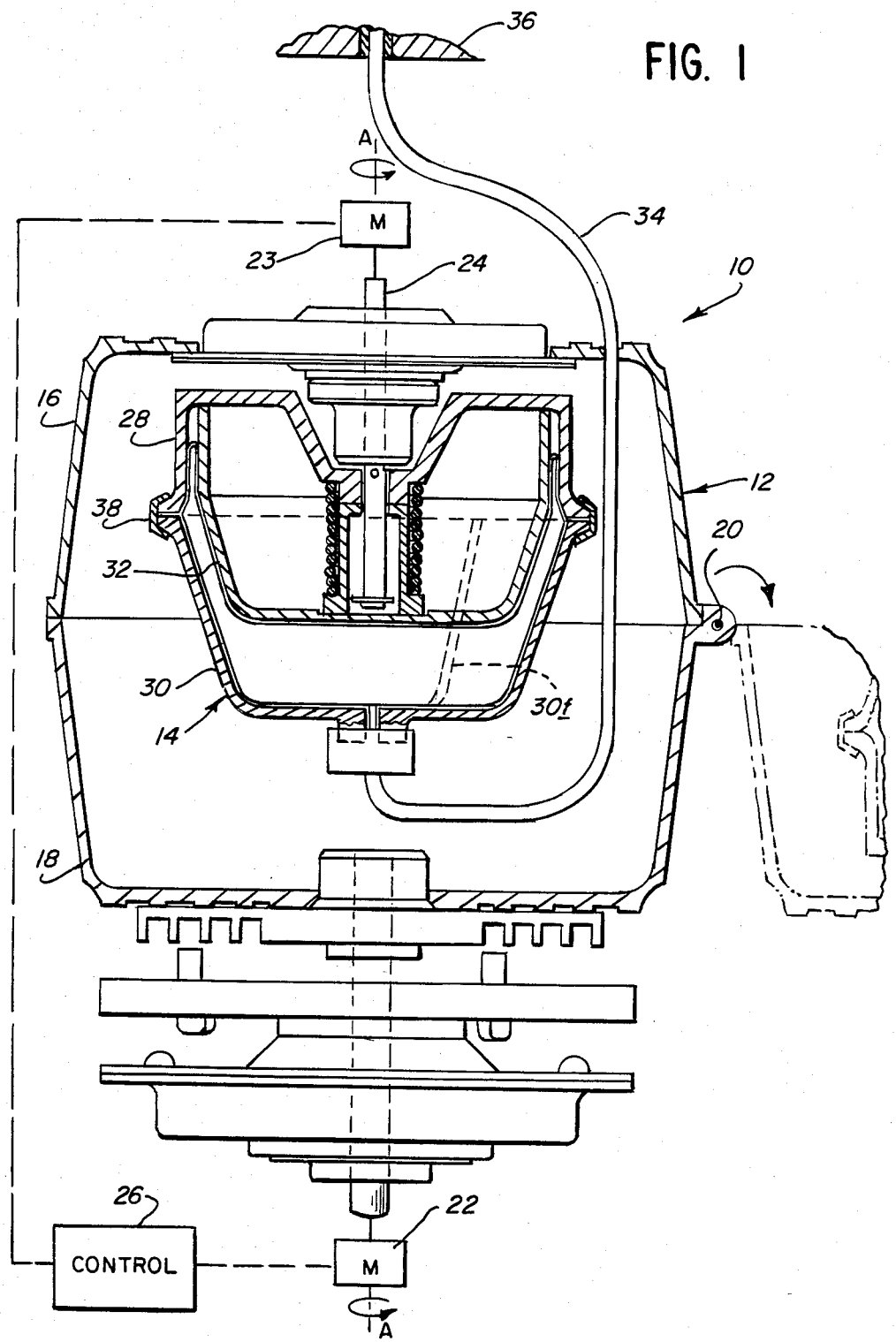
FIG. 1 is a vertical, sectional view showing the basic elements of an on-site centrifugal apheresis apparatus, including a rotatable external housing and an internal chamber support system.

Referring now to FIG. 1, an apparatus for centrifugal apheresis 10 generally is shown and includes a rotatable external assembly or housing 12 and a rotatable inner chamber support assembly 14 which carries the variable-volume chamber and movable mandrel.

The housing 12 is generally cylindrical in shape and includes top and bottom half sections 16 and 18 which are connected by hinge 20. The bottom section 18 is connected to a drive system 22, which spins the outer housing at a first predetermined speed about a spin axis A—A. Different types of drive systems are known in the art and can be employed. See U.S. Pat. Nos. 3,986,442 Khoja et al and Re. 29,738 Adams for exemplary drive systems.

The top section 16 carries the inner chamber support assembly 14, which is positioned within the outer housing 12 and aligned with the spin axis A—A for rotation with the outer housing 12. An inner assembly drive 23 is mounted to the top section 16 and supports the chamber and cooperating members via drive shaft 24. The inner assembly drive spins the inner assembly 14 in the same direction as the outer assembly 12, but at twice the rate.

If the rate of rotation for the outer housing is designated as one-omega (i.e., $1\omega$), then the rate of rotation for the inner assembly is two-omega ($2\omega$) in the same direction. Use of the $1\omega/2\omega$ drive permits the entire apparatus to be connected to the stationary external blood sources and collection sites using conduits or stationary seals (i.e., non-rotating seals).

Systems which employ such drives and fluid connections are disclosed in the previously identified patents as well as U.S. Pat. Nos. 4,108,353 Brown; 4,109,852 Brown et al; and 4,109,855 Brown et al. Furthermore, mechanical and electrical control systems are known for maintaining the $1\omega/2\omega$ drive relationship. A control system designated by block diagram 26 is connected to both drives 22 and 23.

Figure 2:
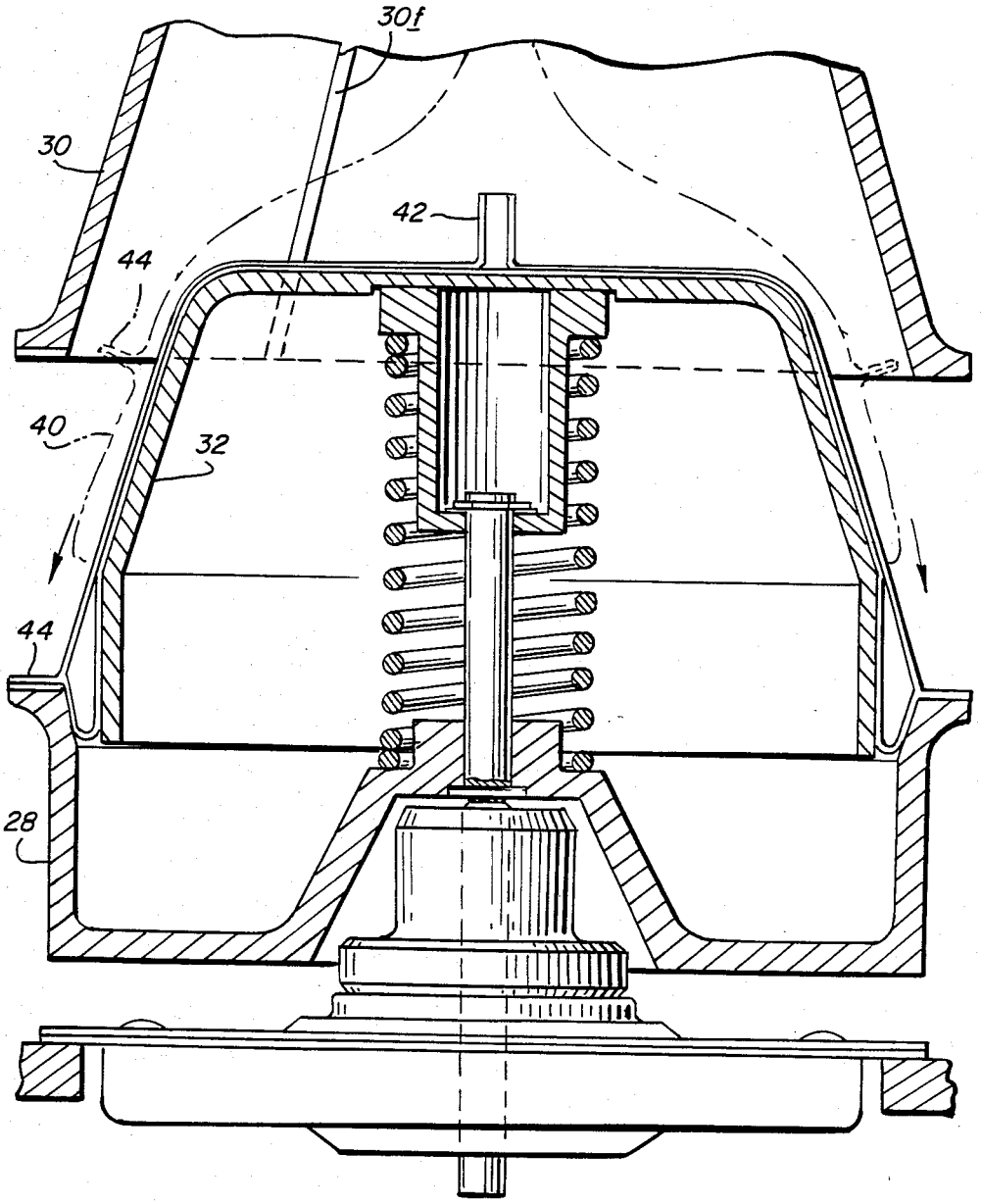
FIG. 2 is a vertical sectional view showing the housing in an open position and the processing chamber mounted on the mandrel.
Figure 3:
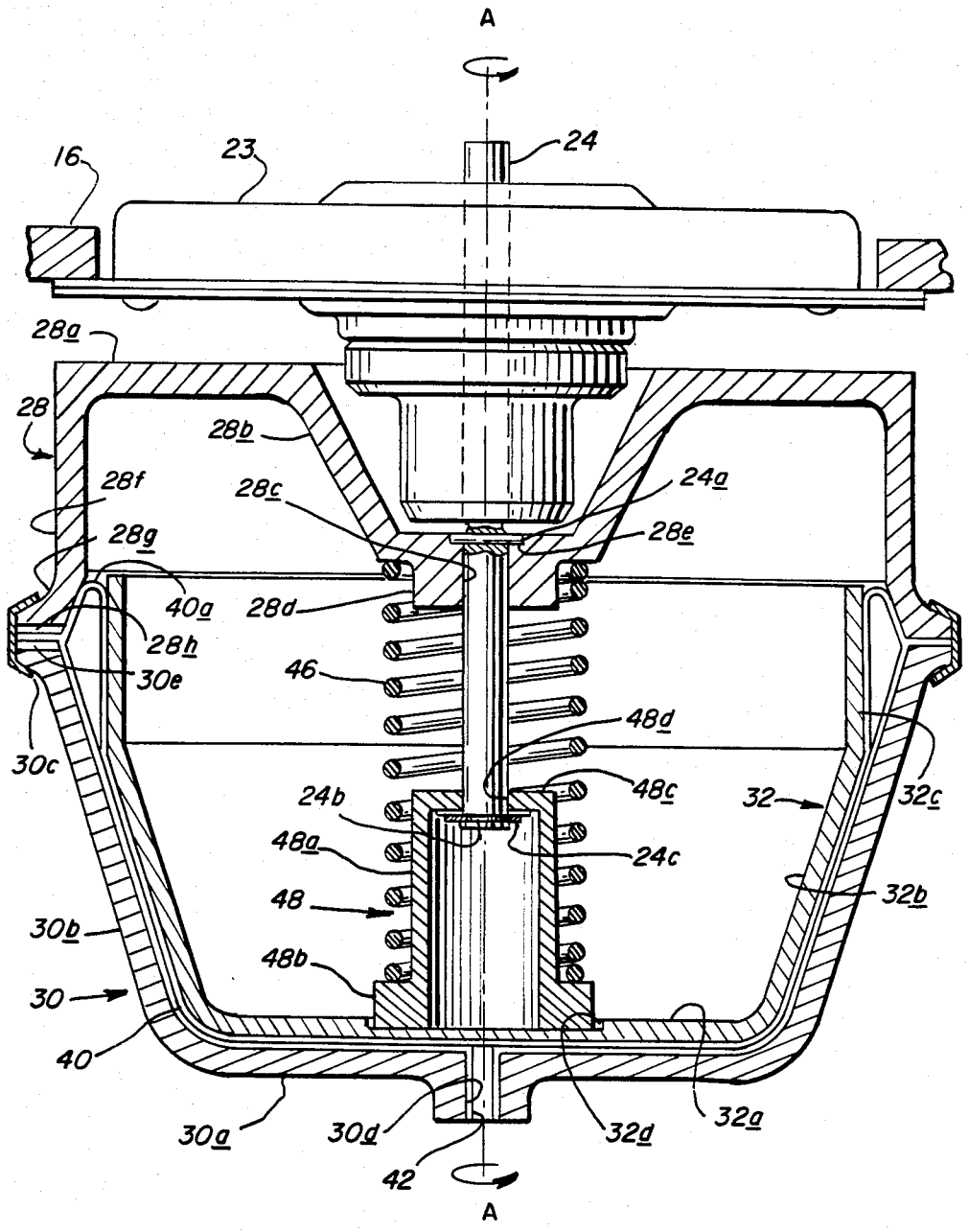
FIG. 3 shows the chamber support system in the operative position.
Figure 4:
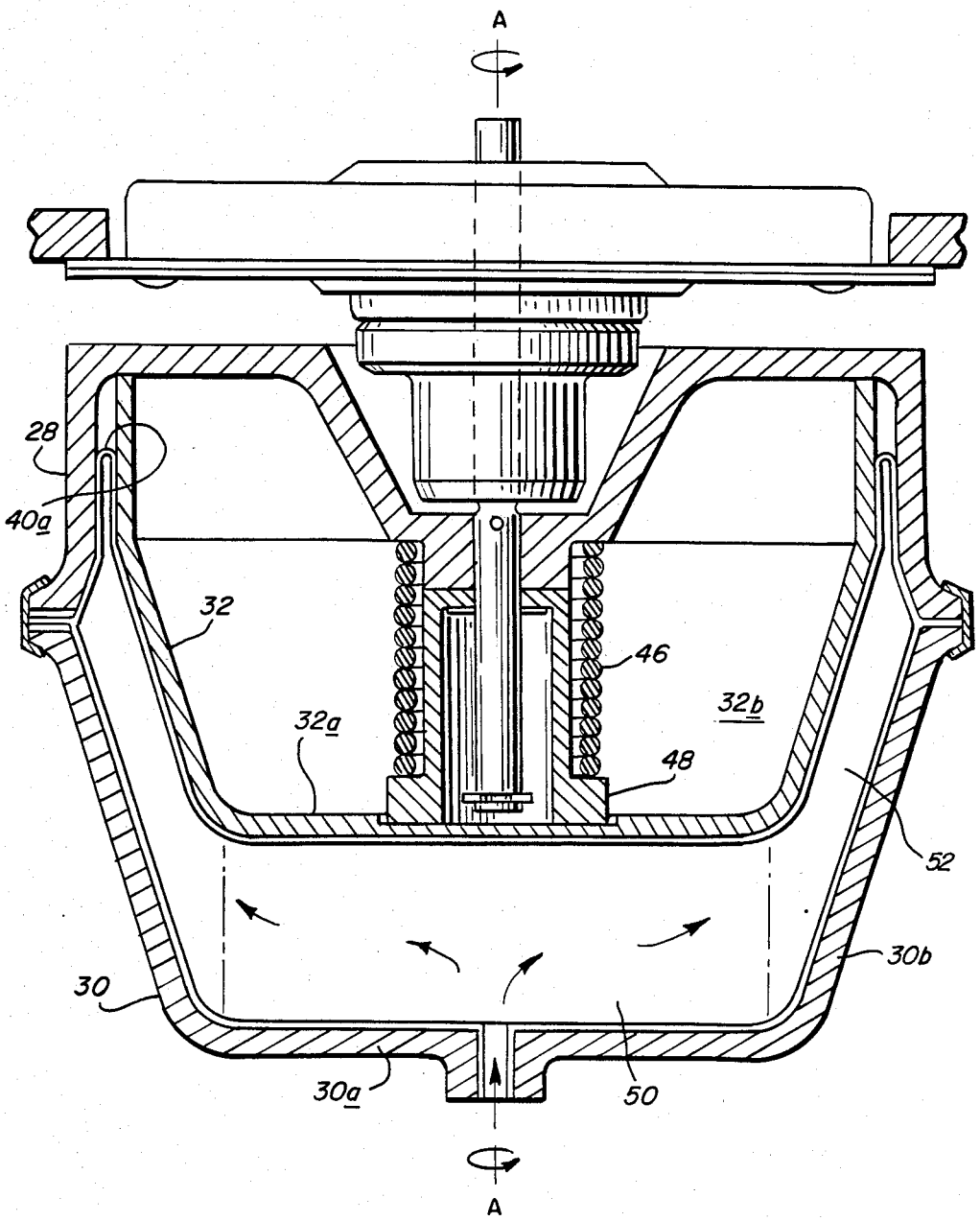
FIG. 4 shows the processing chamber being filled for separation.

The inner assembly includes an inverted cup-shaped chamber support plate 28, which carries the chamber bowl or cover 30 and spring-biased chamber mandrel 32. A flexible, variable-volume, bowl-shaped chamber is positioned in the cover between the cover and mandrel, as best seen in FIGS. 2–4. A fluid conduit, which is sometimes referred to as an umbilicus 34, extends from the cover through the outer housing to a stationary external connection 36. The umbilicus can be either a single or multi-lumen tube. See, for example, U.S. Pat. Nos. 4,132,349Khoja et al and 4,389,207 Bacehowski et al.

The cover 30 is fixed to the chamber support plate 28 by a removable band 38 which releasably secures the cover to the support plate.

Both the outer and inner housings are substantially symmetric about the central spin axis A—A, and during operation, the chamber conforms to the shape of the mandrel and cover and assumes a generally axially symmetric shape.

Mounting of the Chamber

Referring to FIG. 2, the processing chamber, which is a flexible, variable-volume, bowl-shaped member 40, is shown with a fluid communication port 42. This port is to be located on the spin axis A—A and is referred to as the low-gravity (low-G) port. In some systems a port is also located at the radially outermost point and is referred to as the high-G port. In a distended shape the chamber has a bladder-like shape that can be formed to the bowl-like shape.

In order to mount the chamber to the support assembly, the top section 16 of the outer housing is swung open about hinge 20 to an inverted horizontal position, the retainer band 38 is removed, and the chamber bowl cover is removed as shown in FIG. 2. Thereafter, a flexible, variable-volume chamber 40 is fitted to the mandrel 32 by rolling the chamber thereon. This chamber 40 has been fabricated from two heat-sealed and vacuum-formed polyvinylchloride sheets. The sealing flange 44 is shown engaging the support plate 28.

In a sense, the chamber is fitted to the mandrel as a glove is fitted to a hand. In this inverted position the mandrel is extended under a biasing action, but its movement is limited by the drive shaft. After the chamber is fitted to the mandrel, the bowl cover 30 is refitted and secured with the retainer band and the top section is returned to its closed position.

The Internal Assembly

FIG. 3 shows the fully assembled inner assembly with the variable-volume chamber in place. More specifically, the internal drive 23 is supported by the outer housing top section 16. The drive shaft 24 is aligned with the spin axis A—A and extends downwardly from the drive 23 through the support plate 28.

The drive shaft 24 includes a support plate connecting pin **24*a* for establishing a driving connection with the support plate 28**.

The support plate 28 includes a transverse top wall **28*a* which has a downwardly-extending bosslike stub 28*b*. The stub includes an aperture 28*c* through which the drive shaft 24 extends and defines a spring seat 28*d*. A drive pin connecting groove 28*e* is provided on the drive side of the stub 28*b* for driving connection with the pin 24*a*. The support plate also includes a peripheral side wall 28*f* that terminates in an outwardly-extending flange 28*g*. The flange 28*g* may include one-half of a high-G port opening 28*h***.

The bowl cover 30, which is secured to the support plate 28, includes a transverse bottom wall portion **30*a*, and an upwardly-extending and outwardly-tapering side wall portion 30*b* which terminates in flange 30*c* that cooperates with the support plate flange 28*g* for securing the bowl 30 to the plate 28**.

A conduit-receiving aperture **30*d* extends through the bottom wall, is aligned with the spin axis A—A and the low-G port 42 passes therethrough. The flange also includes a high-G port opening 30*e* which can be aligned with port opening 28*h* to form a high-G outlet. The cover 30 has a slot 30*f*** which extends through the side wall from the flange to the port.

The mandrel 32 is positioned inside the cover 30, is shaped to generally conform to the interior of the rotor and has a bottom wall **32*a*, tapering side wall 32*b* and skirt 32*c*. The bottom wall is provided with a retainer recess 32*d***.

A spring-biasing mechanism is provided for urging the mandrel 32 toward the bowl 30 and against the chamber 40. The biasing mechanism includes a coiled compression spring 46 that surrounds the drive shaft 24, and is held in position at the top end by the stub **28*b* and spring seat 28*d* and at the bottom end by post-like keeper 48**.

The post 48 is an elongated, hollow, cylindrically-shaped member which seats in the mandrel recess **32*d*. The post includes a body portion 48*a* which fits within the spring 46 and an outwardly-extending flange or spring seat 48*b* on which the lower end of the spring rests. At the upper end, the post 48 has a top wall 48*c* with an aperture 48*d* through which the drive shaft 24** extends.

The drive shaft has at its lower end a retainer groove **24*b* which is positioned within the post 48 and a C-shaped retainer spring 24*c* which fits within the groove to retain the post 48 on the drive shaft and limits the extension of the spring 46**.

Thus the biasing spring cooperates with the support plate stub **28*b*, post 48, drive shaft 24, pin 24*a*, and retainer 24*c* to urge the mandrel against the processing chamber 40 and toward the bowl 30. The maximum extension of the spring is controlled by the length of the drive shaft, between the pin 24*a* and retainer 24*c*, positioning of the retainer 24*c*, as shown in FIG. 2, mandrel engages the bowl 30 as shown in FIG. 3. The limit for compression of the spring 46 is defined by its solid height; abutment of the post 48 and the stub 28*b*; and/or engagement of the mandrel skirt 32*d*** and support plate.

After assembly and installation of the chamber and closure of the housing, the biasing spring 46 urges the post 48 and, thus the mandrel, downwardly toward the bowl cover. The downward travel of the mandrel is limited by the restraint of the bowl and the engagement of the shaft retainer **24*c* and post 48**. In the fully extended position, the mandrel expresses substantially all fluid from the chamber, and, as shown, the chamber is prepared for receiving whole blood and component separation.

In operation the centrifuge is started with drives 22 and 23, and whole blood drawn from the donor is delivered to the chamber via the umbilicus 34. The whole blood entering the chamber causes the chamber to expand and push against the mandrel 32. As the chamber fills, it conforms to the shape of the mandrel and cover and urges the mandrel toward a retracted position. As the mandrel retracts, the post 48 is pushed upwardly, which causes the spring 46 to compress until the chamber is fully expanded or until the spring reaches its fully compressed solid height where the post abuts the support plate stub.

During separation, therapeutic components may be selectively withdrawn from the chamber through the low-G port 42 (or other ports if provided), thus decreasing the chamber volume. As the chamber volume decreases, the mandrel advances toward the cover, thus maintaining a conforming force against the chamber. As the mandrel advances and retracts in response to volume changes, the rim edge 40*a* of the chamber rolls up and down.

The chamber is sufficiently flexible so as to permit adjustment in volume without fracturing or tearing. It will be noted that the chamber walls may fold back against themselves during this process. At the end of the procedure, the chamber is removed by opening the housing and interior casing and then sliding the chamber off the mandrel.

From the foregoing it will be seen that the apparatus disclosed herein provides an apparatus for centrifugal apheresis in which the volume of the processing chamber is variable.

The RBC and Plasma Volumes

The shape of the bowl 30 and mandrel 32 cooperates with the chamber 40 to define a red blood cell collection volume and a plasma collection volume. Referring to FIG. 4, the plasma collection volume 50 is a cylindrical, disc-like space between the bowl bottom wall 30*a* and the mandrel bottom wall 32*a*. The blood cell collection volume is the annularly-shaped space 52 defined by the bowl side wall 30*b* and the mandrel side wall 32*b*.

The blood cell collection volume 52 and plasma collection volume 50 are approximately equal as shown in the filled condition in FIG. 4. Furthermore, the volumes remain approximately equal to each other as the total volume of the chamber varies. In other words, throughout the range of chamber volumes from empty to full, the ratio of red blood cell or packed cell collection volume to plasma collection volume remains substantially constant at about 1:1.

Referring now to the packed cell collection volume 52, it is seen that during operation the red blood cells sediment toward or are driven toward the bowl wall 30*b*. This wall has a large surface area so as to maximize separation of the red blood cells.

The interface between the packed or red blood cell volume and plasma volume is a cylindrically-shaped surface, shown with dotted lines, which extends between the outer edge of the mandrel bottom wall 32*a* and the outer edge of the cover bottom wall 30*a*. During separation, a layer known as the "buffy layer" forms at that interface due to the separation of the platelets from the plasma. As shown, the interface surface area is smaller than the RBC sedimentation surface. The reason the interface surface area is smaller is to minimize platelet separation during RBC collection.

In the embodiment shown herein, the RBC sedimentation surface area is greater than the platelet interface surface area. Desirably, the ratio of RBC surface area to interface surface area is at least 2:1 and even as great as 4:1. These relationships are selected so as to maximize RBC separation while minimizing platelet from plasma separation and loss into the buffy layer during RBC separation. During RBC separation fluids in the red blood cell volume 52 are exposed to high-G forces, while fluids in the plasma volume 50 are exposed to low-G forces.

In operation, the chamber is filled with whole blood and then subjected to a first or hard spin to obtain RBC separation. During this spin, red blood cells sediment and move radially outwardly and into the volume 52 where the cells then sediment toward the outer wall. During this operation plasma and platelets are displaced inwardly toward the plasma volume 50.

Platelet-rich plasma collects in the volume 50 and is subjected to much lower G or separation forces since its radial distance from the spin axis is less than that for the RBC's. Hence platelet separation from the plasma is minimized.

In one example, the chamber is filled with about 500 milliliters of whole blood having a hematocrit of 40 (i.e., 40 volume percent red blood cells). After spinning and separation, about 250 milliliters of packed red blood cells, with a hematocrit of 80, is obtained in the volume 52 and about 250 milliliters of platelet-rich plasma is available in the plasma volume 50.

Collection of the RBC or platelet-rich plasma can be effected through the high or low-G ports as desired. Thereafter, in subsequent separations platelets can be separated from the plasma so as to permit separate collection of platelets and plateletfree plasma.

It will be appreciated that numerous changes and modifications can be made to the embodiment shown herein without departing from the spirit and scope of this invention.

What is claimed is:

1. A centrifugal liquid processing apparatus comprising a centrifuge bowl having an interior and being mounted for rotation about a spin axis, a mandrel movable within a range of positions within said bowl interior between an extended position and a retracted position, said mandrel and bowl together defining the desired contours of the processing volume of said bowl, said desired contours varying in response to movement of said mandrel to accommodate a range of processing volumes varying between a minimum volume, when said mandrel is in said extended position, and a maximum volume, when said mandrel is in said retracted position, a processing chamber positioned between said mandrel and said bowl, said chamber being flexible to accommodate the expansion and contraction of said chamber within said bowl in response to fluid pressure within said chamber, conduit means for transporting fluid into and out of said processing chamber, and means for moving said mandrel within its range of positions in response to the expansion and contraction of said processing chamber and including means for biasing said mandrel toward said extended position to continuously force said flexible chamber into conformance with the desired contours of each of said processing volumes defined between said mandrel and said bowl in response to movement of said mandrel.

2. An apparatus as in claim 1, wherein, when said mandrel is in said extended position, said mandrel concentrically nests within said centrifuge bowl to define the contours of said minimum processing volume in which said flexible processing chamber is compressed between said mandrel and said bowl and substantially all fluid is expressed therefrom.

3. An apparatus as in claim 1:

wherein said processing chamber is intended to receive whole blood and to separate said whole blood into red blood cells and platelet-rich plasma in response to centrifugal force, wherein said bowl includes a transverse bottom wall and upwardly-extending side walls;

whereby said mandrel includes a transverse bottom wall and upwardly-extending side walls, and wherein each of said processing volumes into which said processing chamber is forced into conformance by said mandrel includes a red blood cell processing volume located between said side walls of said mandrel and said bowl, said red blood cell processing volume having a red blood cell sedimentation surface formed along said associated side walls of said bowl, a plasma processing volume located between said bottom walls of said bowl and said mandrel, and a blood/plasma interface located between said red blood cell processing volume and said plasma processing volume.

4. An apparatus as in claim 1 wherein a portion of said processing chamber is attached in a conformance fit about said mandrel.

5. An apparatus as in claim 1, wherein said bowl and said mandrel are substantially symmetric about said spin axis.

6. An apparatus as in claim 5, wherein said means for moving and biasing said mandrel are operative for moving said mandrel axially along said spin axis between said extended and retracted positions.

7. An apparatus as in claim 1, and further including drive means operatively associated with said bowl, said mandrel and said processing chamber for simultaneously spinning said bowl, said mandrel and said processing chamber at a controllable and predetermined rate.

8. An apparatus as in claim 7, and further including means operatively associated with said conduit means for rotating said conduit means at a rate which is one-half the rate of said drive means.

9. An apparatus as in claim 1, wherein said means for biasing said mandrel comprises compression spring means aligned with said spin axis and seated at one end against a support plate and at the other end against an inner surface of said mandrel for urging said mandrel away from said support plate and toward the interior of said centrifuge bowl.

10. An apparatus as in claim 9, wherein said support plate includes stub means for securing one end of said spring means, and further including post means for engaging the inner surface of said mandrel for securing the other end of said spring means.

11. An apparatus as in claim 10 wherein said means for moving said mandrel includes a shaft which extends through said stub means and said post means, and retainer means on the end of said shaft for retaining said post means on said shaft.

12. An apparatus as in claim 11, and further including drive means operatively coupling said shaft to said bowl and said mandrel for spinning said bowl, and said mandrel about said spin axis in response to rotation of said shaft.

13. An apparatus as in claim 11, wherein said stub means includes a drive pin-receiving groove transverse to said spin axis, and wherein said shaft includes a transverse drive pin to engage said groove for drivingly connection said groove with said pin.

14. An apparatus as in claim 13, wherein said post means is cyclindrically shaped, has a hollow interior and an apertured transverse top wall, and wherein said shaft extends through said aperture and said retainer means is within said hollow interior.

15. An apparatus as in claim 14, wherein the extension of said spring means is limited by the length of said shaft between said stub means and said retainer means, thereby defining said extended position of said mandrel.

16. An apparatus as in claim 15, wherein the compression of said spring means is limited either by the abutment of said post means against said stub means or by the abutment of said mandrel against said support plate, thereby defining said retracted position of said mandrel.

* * * * *